US012492055B2

(12) United States Patent
Merzeau

(10) Patent No.: US 12,492,055 B2
(45) Date of Patent: Dec. 9, 2025

(54) ARTICLE CARRIERS AND BLANKS THEREFOR

(71) Applicant: WestRock Packaging Systems, LLC, Atlanta, GA (US)

(72) Inventor: Julien D. Merzeau, Chateauroux (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 18/011,961

(22) PCT Filed: Jun. 23, 2021

(86) PCT No.: PCT/US2021/038700

§ 371 (c)(1),
(2) Date: Dec. 21, 2022

(87) PCT Pub. No.: WO2021/262858

PCT Pub. Date: Dec. 30, 2021

(65) Prior Publication Data

US 2023/0234763 A1 Jul. 27, 2023

Related U.S. Application Data

(60) Provisional application No. 63/042,850, filed on Jun. 23, 2020.

(51) Int. Cl.
*B65D 71/44* (2006.01)

(52) U.S. Cl.
CPC .... *B65D 71/44* (2013.01); *B65D 2571/00444* (2013.01); *B65D 2571/0066* (2013.01)

(58) Field of Classification Search
CPC ..... B65D 71/42; B65D 71/44; B65D 2571/00444; B65D 2571/0066
(Continued)

(56) References Cited

U.S. PATENT DOCUMENTS

2017/0225859 A1 8/2017 Hayter

FOREIGN PATENT DOCUMENTS

BE 628149 A 5/1963
EP 2085314 A2 8/2009
(Continued)

OTHER PUBLICATIONS

International Search Report issued in PCT/US2021/038700, dated Oct. 12, 2021.
Colombian Office Action dtd Jul. 16, 2025, 10 pages.

*Primary Examiner* — Bryon P Gehman
(74) *Attorney, Agent, or Firm* — Brian J. Goldberg; Tsugihiko Suzuki; Rohini K. Garg

(57) ABSTRACT

Aspects of the disclosure relate to article carriers (90) for forming a package and blanks (10; 110; 210; 310) for forming the article carriers (90). The blank (10; 110; 210; 310) comprises at least one panel (12; 112; 212; 312) having at least four article receiving openings (RT1). The at least one panel (12; 112; 212; 312) comprises a handle feature. The at least article receiving openings (RT1) are arranged in two rows. The handle feature comprises at least one handle opening (Ha1, Ha2, Ha3) located at a centre (C) of the at least four article receiving openings (RT1). The at least one handle opening (Ha1, Ha2, Ha3) is defined at least in part by a pair of first tabs (16, 18; 140, 142; 216, 218; 340, 342, 370, 372, 374, 376) hingedly connected to the at least one panel (12; 112; 212; 312) by a pair of first divergent fold lines (17, 19; 141, 143; 341, 343, 373*a*, 373*b*, 375*a*, 375*b*) respectively. Each of the first tabs (16, 18; 140, 142; 216, 218; 340, 342, 370, 372, 374, 376) comprises a height dimension (H1) extending between the respective first fold line (17, 19; 141, 143; 341, 343, 373*a*, 373*b*, 375*a*, 375*b*) and a free end of that first tab (16, 18; 140, 142; 216, 218; 340, 342, 370, 372, 374, 376). The height dimension (H1) may be equal to or greater
(Continued)

than a distance (He) between the centre (C) and each of the first fold lines (17, 19; 141, 143; 341, 343, 373*a*, 373*b*, 375*a*, 375*b*).

20 Claims, 9 Drawing Sheets

(58) Field of Classification Search
USPC ..... 206/139
See application file for complete search history.

(56) References Cited

FOREIGN PATENT DOCUMENTS

| | | | |
|---|---|---|---|
| JP | 2012/245996 | A | 12/2012 |
| WO | 2013/134346 | A1 | 9/2013 |
| WO | 2016/100010 | A1 | 6/2016 |

ARTICLE CARRIERS AND BLANKS THEREFOR

CROSS REFERENCE TO RELATED APPLICATIONS

This Application is a U.S. 371 National Phase Patent Application of International PCT Patent Application No. PCT/US2021/038700, filed Jun. 23, 2021, which claims priority to U.S. Provisional Patent Application No. 63/042,850, filed on Jun. 23, 2020. The entire contents of these applications are incorporated herein by reference.

TECHNICAL FIELD

The present invention relates to packages, to article carriers and to blanks for forming the same. More specifically, but not exclusively, the invention relates to a package comprising a carrier having a main panel comprising one or more apertures for receiving an article and handle structure.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting a weight of grouped articles. It is desirable that the contents of the carton are securely held by the carton and that the cartons or carriers are easy for a consumer to grasp and carry.

It is an object of the present disclosure to provide an article carrier for substantially cylindrical articles having a minimalistic appearance and having a carrying handle.

The present invention seeks to provide an improvement in the field of cartons, typically formed from paperboard or the like.

SUMMARY

A first aspect of the invention provides a blank for forming an article carrier. The blank comprises at least one panel having at least four article receiving openings and a handle feature. The at least four article receiving openings are arranged in two rows. The handle feature comprises at least one handle opening located at a centre of the at least four article receiving openings. The at least one handle opening is defined, at least in part, by a pair of first tabs hingedly connected to the at least one panel by a pair of first divergent fold lines respectively. Each of the first tabs has a height dimension extending between the respective first fold line and a free end of that first tab. The height dimension is equal to or greater than a distance between the centre and each of the first fold lines.

Optionally, the at least one handle opening is defined, in part, by a pair of second tabs hingedly connected to the at least one panel by a pair of second divergent fold lines respectively, each of the second tabs has a height dimension that extends between the respective second fold line and a free end of that second tab, the height dimension is equal to or less than a second distance between the centre and each of the second fold lines.

A second aspect of the invention provides an article carrier for packaging a plurality of articles. The article carrier comprises at least one panel having at least four article receiving openings and a handle feature. The at least four article receiving openings are arranged in two rows. The handle feature comprises at least one handle opening located at a centre of the at least four article receiving openings. The at least one handle opening is defined, at least in part, by a pair of first tabs hingedly connected to the at least one panel by a pair of first divergent fold lines respectively. Each of the first tabs has a height dimension extending between the respective first fold line and a free end of that first tab. The height dimension is equal to or greater than a distance between the centre and each of the first fold lines.

A third aspect of the invention provides a blank for forming an article carrier. the blank comprises at least one panel having at least four article receiving openings and a handle feature. The at least four article receiving openings are arranged in two rows. The handle feature comprises at least one handle opening located at a centre of the at least four article receiving openings. The at least one handle opening is defined, at least in part, by a pair of first tabs hingedly connected to the at least one panel by a pair of first divergent fold lines respectively. The first tabs are disposed next to each other and are separated from each other by a cut passing through the centre such that the cut is divided into first and second segments, the second segment being shorter than the first segment.

Optionally, the length of the cut is greater than a half of a maximum dimension of the at least one handle opening measured along a lateral direction of the blank.

A fourth aspect of the invention provides an article carrier for packaging a plurality of articles. The article carrier comprises at least one panel having at least four article receiving openings and a handle feature. The at least four article receiving openings are arranged in two rows. The handle feature comprises at least one handle opening located at a centre of the at least four article receiving openings. The at least one handle opening is defined, at least in part, by a pair of first tabs hingedly connected to the at least one panel by a pair of first divergent fold lines respectively. The first tabs are disposed next to each other and are separated from each other by a cut passing through the centre such that the cut is divided into first and second segments, the second segment being shorter than the first segment.

A fifth aspect of the invention provides a blank for forming an article carrier. The blank comprises at least one panel having at least four article receiving openings and a handle feature. The at least four article receiving openings are arranged in two rows. The handle feature comprises at least one handle opening located at a centre of the at least four article receiving openings. The at least one handle opening is defined, at least in part, by a pair of second tabs hingedly connected to the at least one panel by a pair of second divergent fold lines respectively. Each of the second tabs has a height dimension extending between the respective second fold line and a free end of that second tab. The height dimension is equal to or less than a distance between the centre and each of the second fold lines.

A sixth aspect of the invention provides an article carrier for packaging a plurality of articles. The article carrier comprises at least one panel having at least four article receiving openings and a handle feature. The at least four article receiving openings are arranged in two rows. The handle feature comprises at least one handle opening located at a centre of the at least four article receiving openings. The at least one handle opening is defined, at least in part, by a pair of second tabs hingedly connected to the at least one panel by a pair of second divergent fold lines respectively. Each of the second tabs has a height dimension extending between the respective second fold line and a free end of that second tab. The height dimension is equal to or less than a distance between the centre and each of the second fold lines.

A seventh aspect of the invention provides a blank for forming an article carrier. The blank comprises at least one panel having at least four article receiving openings and a handle feature. The at least four article receiving openings are arranged in two rows. The handle feature comprises at least one handle opening located at a centre of the at least four article receiving openings. The at least one handle opening is defined, at least in part, by a pair of tabs hingedly connected to the at least one panel by a pair of divergent fold lines respectively. The tabs are disposed next to each other and are separated from each other by a cut which is collinear with a notional line passing though the centre.

Optionally, the cut terminates on the centre.

Optionally, the cut comprises a proximal terminal end located at an edge of the at least one handle opening and distal terminal end which is spaced apart from the centre.

Optionally, the cut comprises a length that is equal to or less than half of a maximum dimension of the at least one handle opening measured along the notional line.

An eighth aspect of the invention provides an article carrier for packaging a plurality of articles. The article carrier comprises at least one panel having at least four article receiving openings and a handle feature. The at least four article receiving openings are arranged in two rows. The handle feature comprises at least one handle opening located at a centre of the at least four article receiving openings. The at least one handle opening is defined at least in part by a pair of tabs hingedly connected to the at least one panel by a pair of divergent fold lines respectively. The tabs are disposed next to each other and are separated from each other by a cut which is collinear with a notional line passing though the centre.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the packages, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
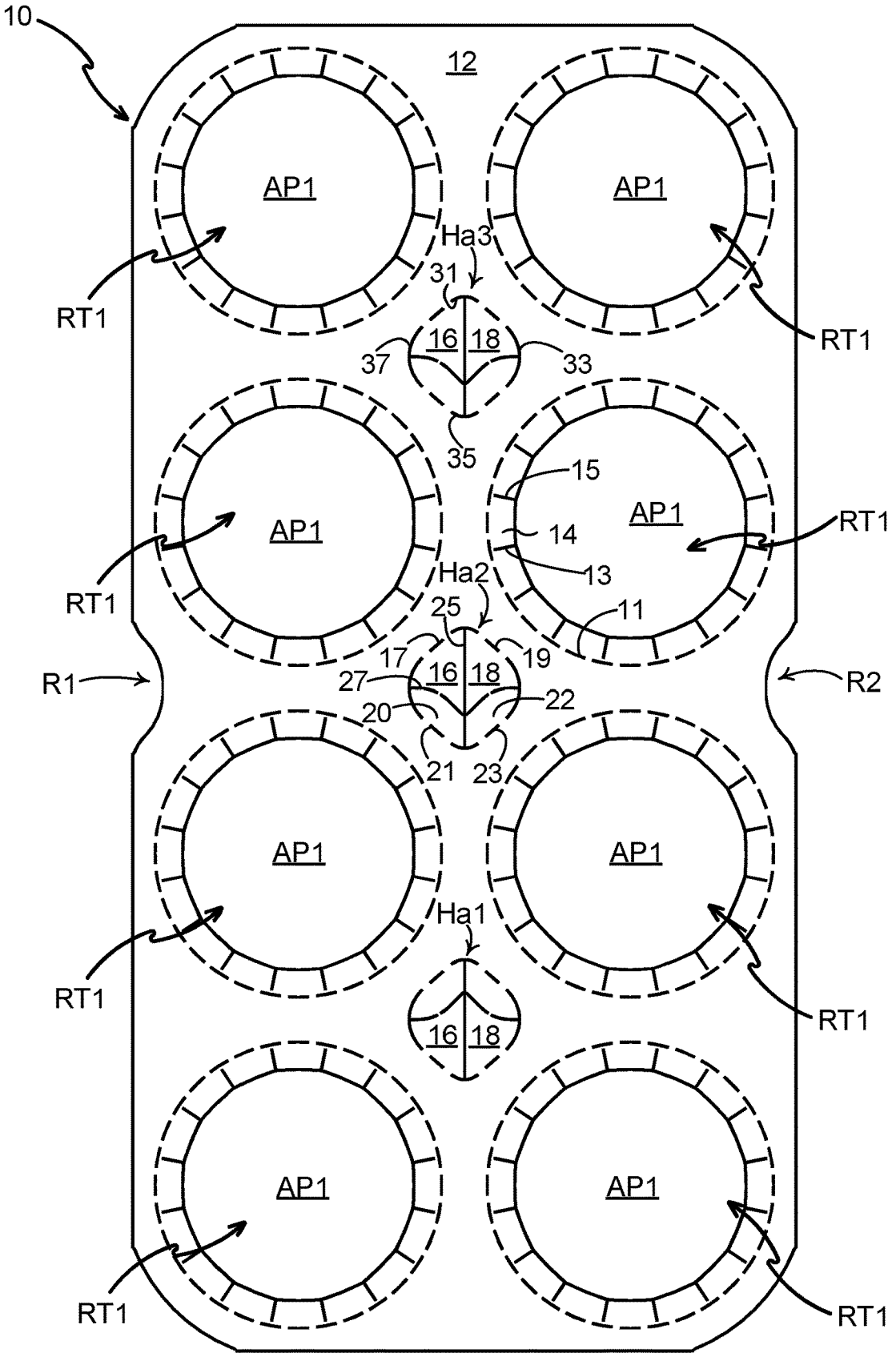
FIG. 1 is a plan view from above of a blank for forming an article carrier according to a first embodiment.
Figure 2:
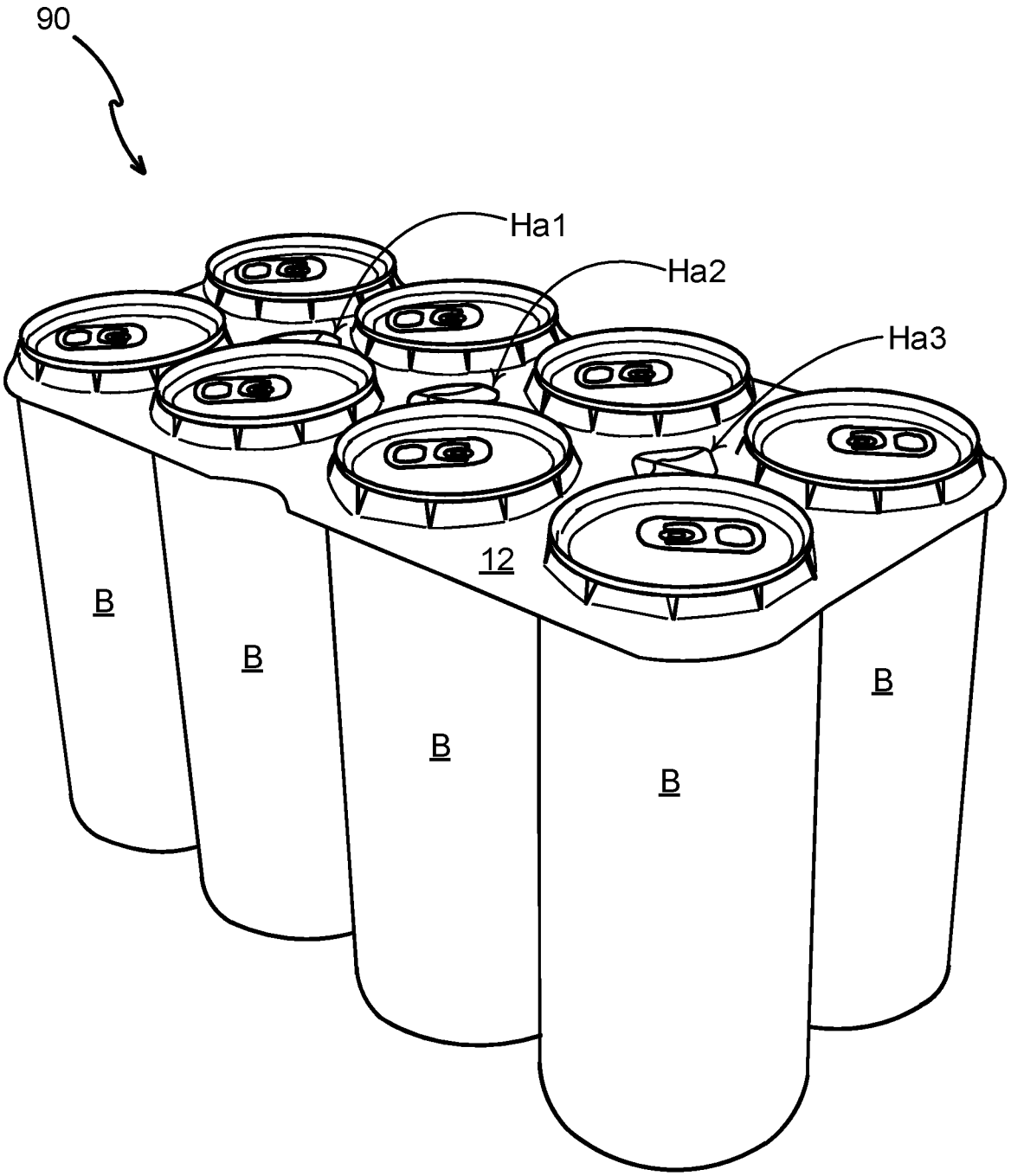
FIG. 2 is a perspective view from above of an article carrier formed from the blank of FIG. 1.
Figure 3:
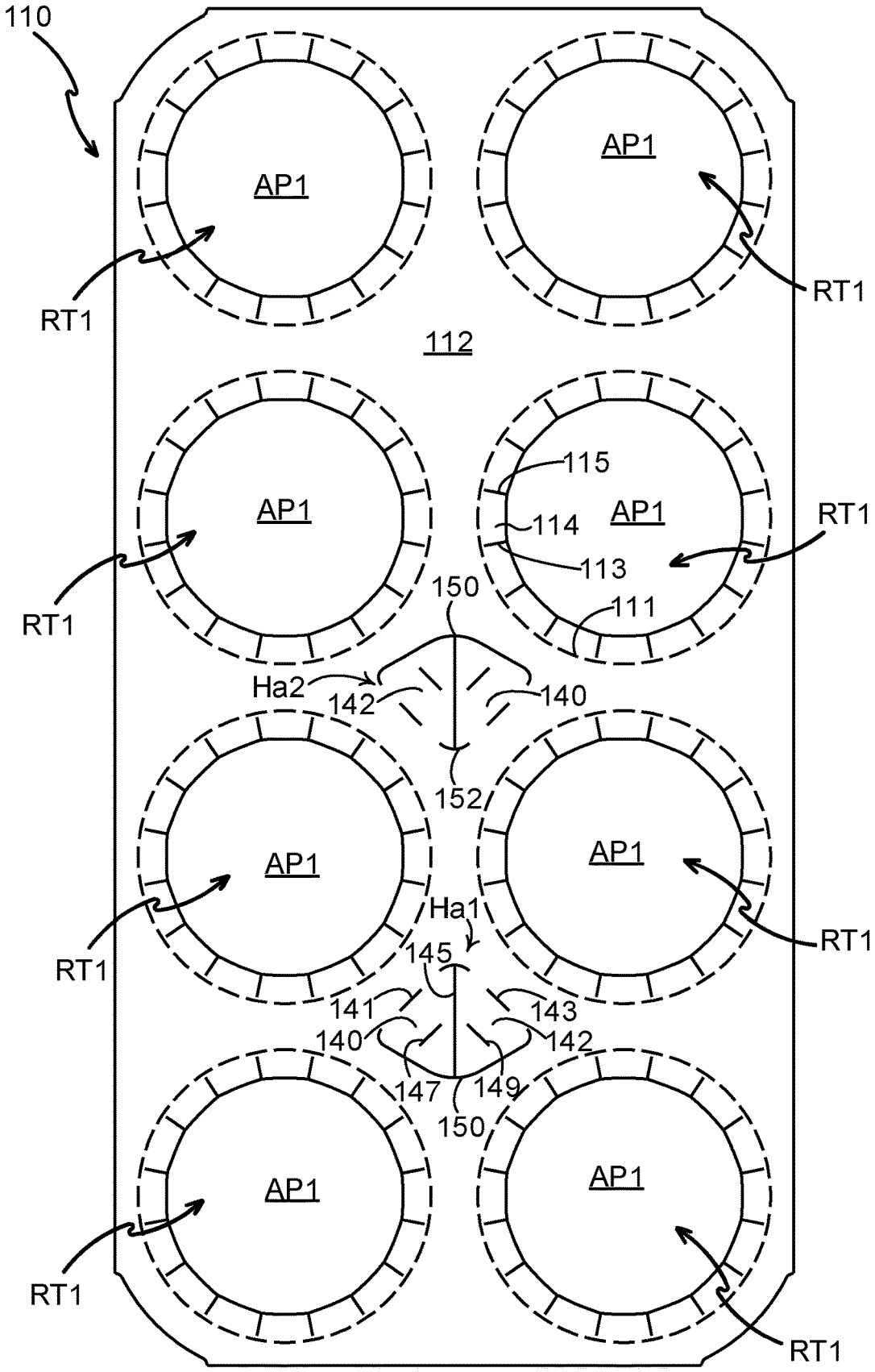
FIG. 3 is a plan view from above of a blank for forming an article carrier according to a second embodiment.
Figure 4:
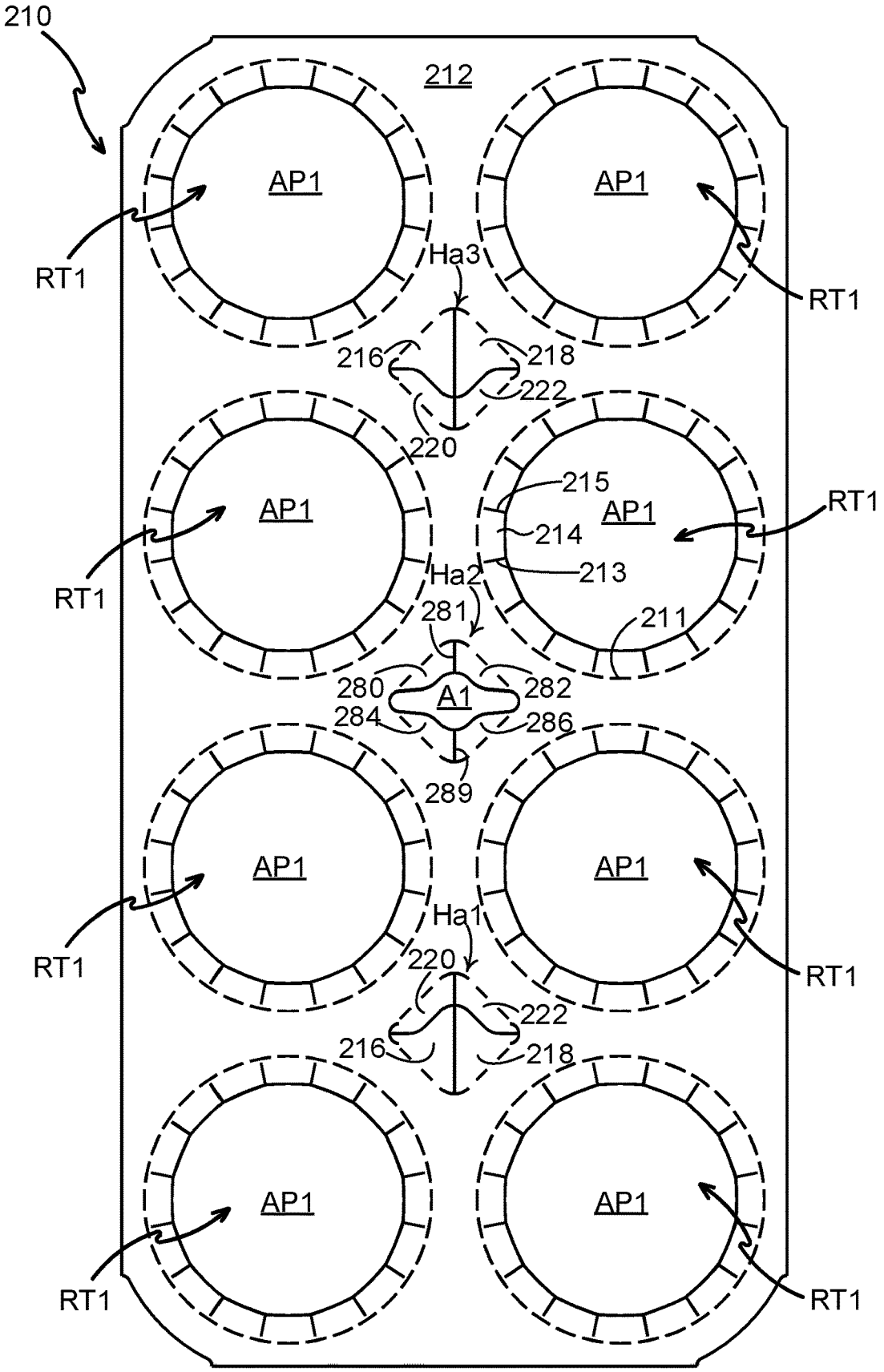
FIG. 4 is a plan view from above of a blank for forming an article carrier according to a third embodiment.
Figure 5:
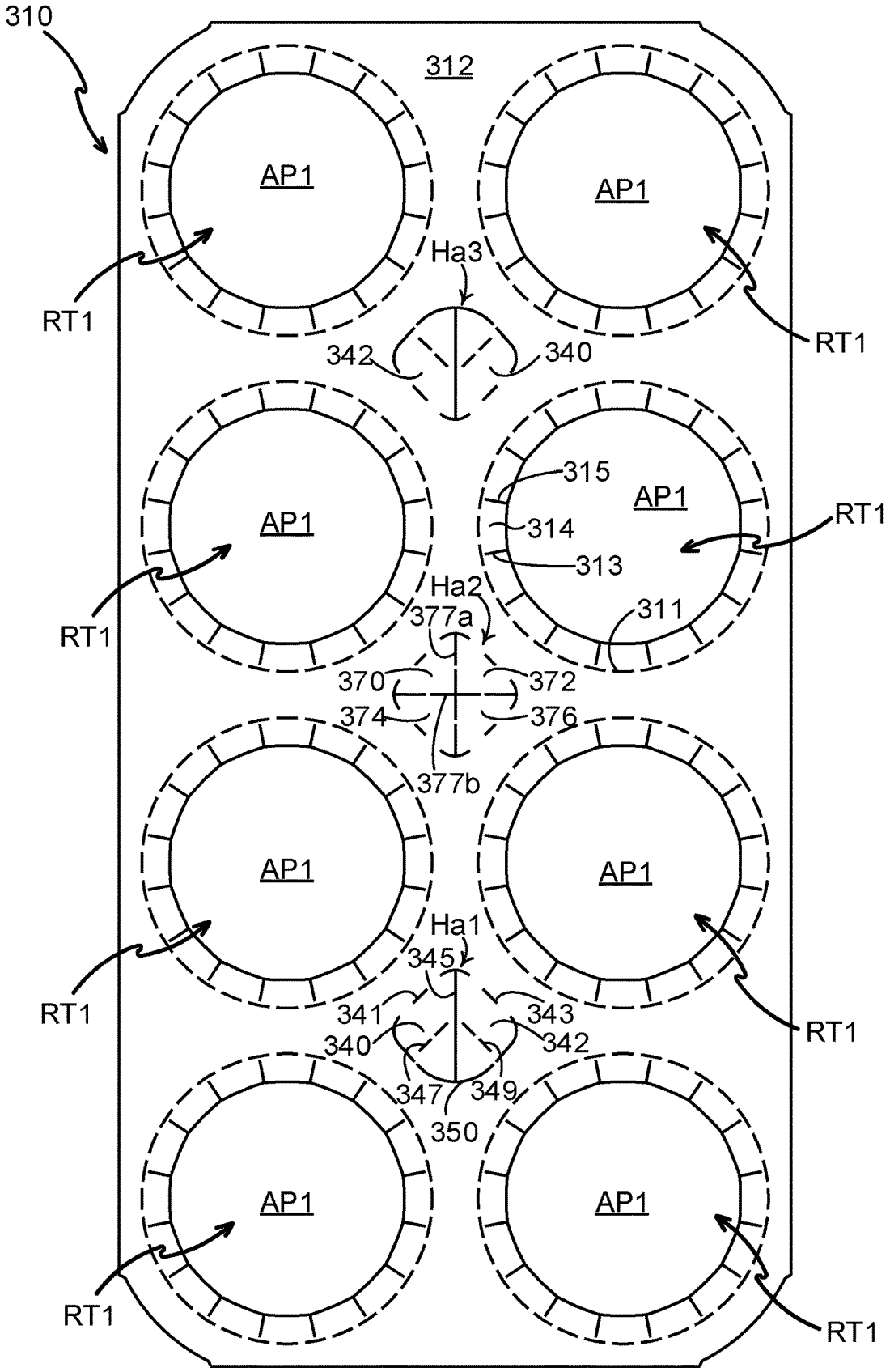
FIG. 5 is a plan view from above of a blank for forming an article carrier according to a fourth embodiment.

Referring to FIG. 1, there is shown a plan view of a blank 10 which is capable of forming a carton or carrier 90, as shown in FIG. 2. The carrier 90 is suitable for containing and carrying a group of primary products such as, but not limited to, bottles or cans, hereinafter referred to as articles B. The blank 10 forms a secondary package 90 that packages at least one primary product container B. Alternative blanks 110; 210; 310 are shown in FIGS. 3, 4, and 5 for forming an alternative carton or carrier (not shown).

In the embodiments detailed herein, the terms "carton" and "carrier" refer, for the non-limiting purpose of illustrating the various features of the invention, to a container for engaging and carrying articles, such as primary product containers (articles B). It is contemplated that the teachings of the invention can be applied to various product containers, which may or may not be tapered and/or cylindrical. Exemplary containers may include bottles (for example metallic, glass or plastics bottles), cans (for example aluminum cans), tins, pouches, packets and the like.

The blanks 10, 110, 210, 310 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure 90 described in more detail below.

The packaging structures or cartons 90, described herein, may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blanks 10; 110; 210; 310 are configured to form a carton or carrier 90 for packaging an exemplary arrangement of exemplary articles B. In the embodiments illustrated, the arrangement is a 4×2 matrix or array. In the illustrated embodiments four rows of two articles are provided, and the articles B are beverage cans. Alternatively, the blanks 10; 110; 210; 310 can be configured to form a carrier for packaging other types, number and size of articles and/or for packaging articles in a different arrangement or configuration.

FIG. 1 illustrates a first embodiment and shows the blank 10 for forming the article carrier 90 shown in FIG. 2. The carrier 90 takes the form of a top gripping clip. The article carrier 90 comprises openings configured to receive the articles B. The openings are arranged to accommodate a neck or upper portion of an article B, above a main body and/or shoulders of the article B.

The blank 10 comprises an engaging panel 12. The engaging panel 12 comprises a plurality of article retention structures RT1, each article retention structure RT1 provides an article receiving opening for receiving a respective article B. The article retention structures RT1 may comprise an article receiving aperture AP1 about which a plurality of teeth or tabs 14 may be disposed. Each of the teeth 14 is struck from the engaging panel 12 and is hingedly connected thereto. Each tooth 14 may be defined, in part, by a pair of cut lines 13, 15. The cut lines 13, 15 extend radially outward from a centre of the article receiving aperture AP1. A circumferential fold line 11 may surround the annular series of tabs 14. The cut lines 13, 15 may terminate at, or proximate to, the circumferential fold line 11.

The retention structures RT1 may each comprise sixteen tabs 14, and each tab 14 may comprise a linear engaging edge which defines a part of the article receiving aperture AP1. The article receiving aperture AP1 may be a polygon, in the illustrated embodiment a hexadecagon.

The blank 10 comprises a handle structure. The handle structure comprises one, two, three or more handle or finger openings spaced apart from each other.

The handle or finger openings are disposed on a longitudinal axis x (see FIG. 1B) bisecting the engaging panel 12.

A first opening Ha1 is provided between a first group of four article retention structures RT1. The first group of four article retention structures RT1 is provided adjacent a first end of the engaging panel 12. The first opening Ha1 is disposed between a first row of article retention structures RT1 and a second row of article retention structures RT1. The first opening Ha1 is located at the centre of the first group of four article retention structures RT1.

A second opening Ha2 is provided between a second group of four article retention structures RT1. The second group of four article retention structures RT1 is provided medially of the engaging panel 12. The second opening Ha2 is disposed between the second row of article retention structures RT1 and a third row of article retention structures RT1. The second opening Ha2 is located at the centre C (see FIG. 1B) of the second group of four article retention structures RT1.

A third opening Ha3 is provided between a third group of four article retention structures RT1. The third group of four article retention structures RT1 is provided adjacent a second end of the engaging panel 12. The third opening Ha3 is disposed between the third row of article retention structures RT1 and a fourth row of article retention structures RT1. The third opening Ha3 is located at the centre of the third group of four article retention structures RT1.

The first, second and third openings Ha1, Ha2, Ha3 lie, at least in part, between a first column of article retention structures RT1 and a second column of article retention structures RT1.

Each of the handle openings Ha1, Ha2, Ha3 is defined by a plurality of tabs 16, 18, 20, 22. The second and third handle openings Ha2, Ha3 are substantially similar in construction to each other. The first handle opening Ha1 is substantially similar in construction to the second and third handle openings Ha2, Ha3 albeit a mirror image thereof. The handle openings Ha1, Ha2, Ha3 will be described in further detail by reference to the second handle opening Ha2 shown in FIG. 1B.

Each handle opening Ha1, Ha2, Ha3 comprises four tabs 16, 18, 20, 22. Each tab 16, 18, 20, 22 is hinged to the engaging panel 12 by a hinged connection in the form of a fold line 17, 19, 21, 23. An arcuate or curvilinear cut line 31, 33, 35, 37 may be provided between each fold line 17, 19, 21, 23 to define a corner or vertex of the handle openings Ha1, Ha2, Ha3. Each of the handle openings Ha1, Ha2, Ha3 is substantially rhombus or diamond shaped, in other embodiments other shapes may be employed such as, but not limited to square. Each handle opening Ha1, Ha2, Ha3 comprises a pair of major tabs 16, 18 and a pair of minor tabs 20, 22.

A first major tab 16 is separated from a second major tab 18 by a first cut line or severable line 25. A first minor tab 20 is separated from a second minor tab 22 by the first cut line or severable line 25.

The first and second minor tabs 20, 22 are separated from the first and second major tabs 16, 18 by a second cut line or severable line 27.

The first cut line 25 is colinear with a notional line x-x passing though the centre C of the group of four article retention structures RT1.

The first cut line 25 may be linear in shape and may extend between a first pair of opposed vertices of the handle opening Ha1, Ha2, Ha3.

The second cut line 27 may be non-linear in shape and may extend between a second pair of opposed vertices of the handle opening Ha1, Ha2, Ha3. The second cut line 27 intersects the first cutline 25, the second cut line 27 comprises a "V" shaped medial portion; a vertex of the "V" shaped portion intersects the first cutline 25.

The first major tab 16 is hinged to the engaging panel 12 by a first fold line 17. The second major tab 18 is hinged to the engaging panel 12 by a second fold line 19.

The first minor tab 20 is hinged to the engaging panel 12 by a third fold line 21. The second minor tab 22 is hinged to the engaging panel 12 by a fourth fold line 23.

The first fold line 17 is divergently arranged with respect to the second fold line 19.

The first fold line 17 is divergently arranged with respect to the third fold line 21.

The second fold line 19 is divergently arranged with respect to the fourth fold line 23.

The third fold line 21 is divergently arranged with respect to the fourth fold line 23.

Figure 1B:
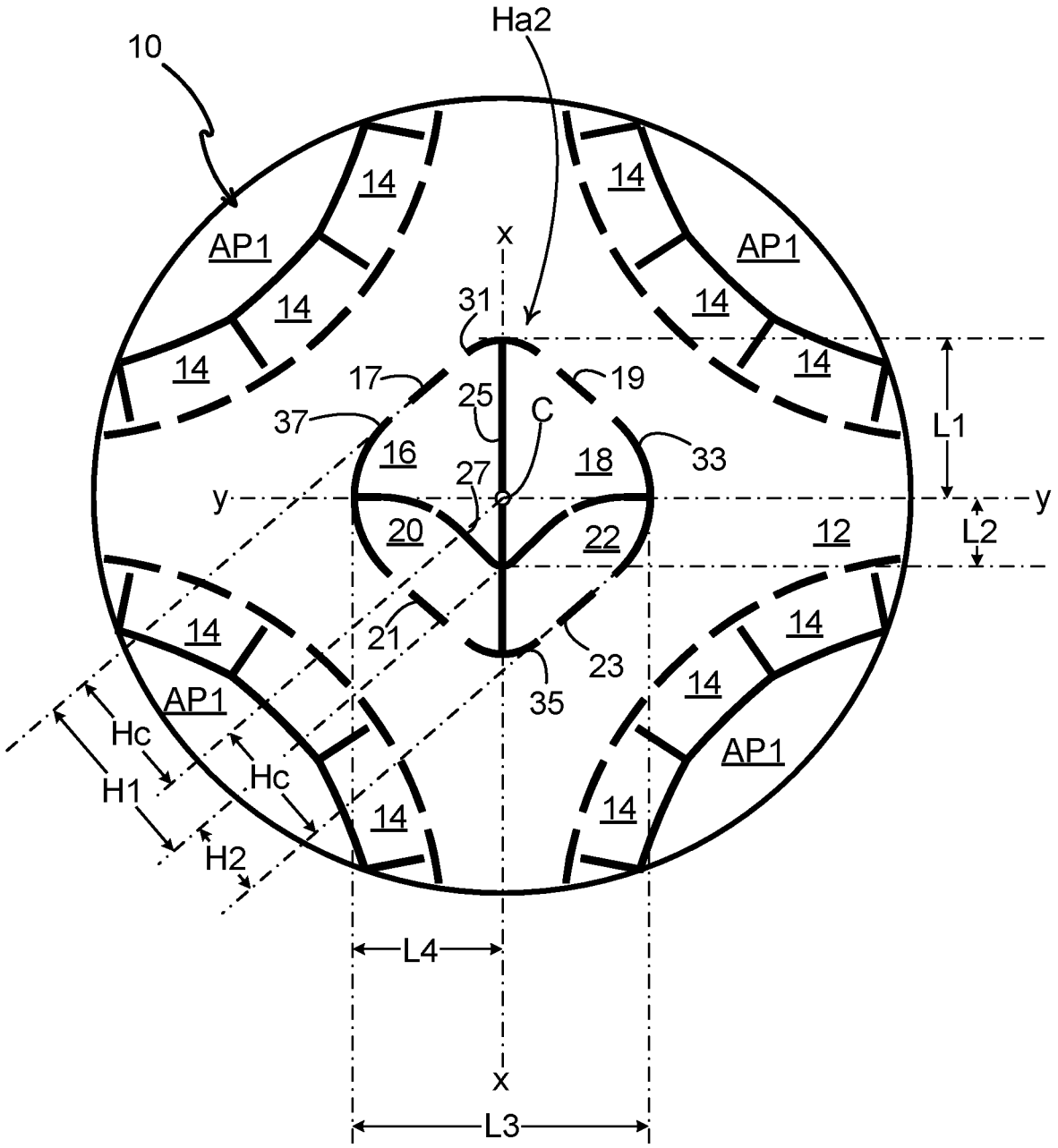
FIG. 1B is an enlarged plan view of a portion of the blank of FIG. 1.

The first and second major tabs 16, 18 comprise a height dimension H1, see FIG. 1B. The height dimension H1 of the first and second major tabs 16, 18 is greater than a distance Hc; where the distance Hc is defined as the distance between a centre C of the second group of article retention structures RT1 and a centre or midpoint of the fold line 17, 19 hinging the first and second major tabs 16, 18 respectively to the engaging panel 12.

The first and second minor tabs 20, 22 comprise a height dimension H2, see FIG. 1B. The height dimension H2 of the first and second minor tabs 20, 22 is less than a distance Hc; where the distance Hc is defined as the distance between the centre C of the second group of article retention structures RT1 and a centre or midpoint of the fold line 21, 23 hinging the first and second minor tabs 20, 22 respectively to the engaging panel 12.

The first and second major tabs 16, 18 are disposed next to each other and are separated from each other by the first cut line 25. The first cut line 25 passes through the centre C of the second group of article retention structures RT1. The first cut line 25 comprises a first segment defined between the centre C of the second group of article retention structures RT1 and a proximal end of the first cut line 25 defined by a first arcuate cut line 31 disposed between the first and second fold lines 17, 19. The first cut line 25 comprises a second segment defined between the centre C of the second group of article retention structures RT1 and a distal end of the first cut line 25. The distal end of the first cut line 25 is defined by a free end edge of the first and second major tabs 16, 18, which is defined by the second cutline 27. The first segment has a first length dimension L1, the second segment has a second length dimension L2. The first length dimension L1 is greater than the second length dimension L2. In this way the first segment is a longer segment, and the second segment is a shorter segment.

The first cut line 25 comprises a third length dimension (L1+L2) which is equal to the sum of the first length dimension L1 and the second length dimension L2. The third length dimension (L1+L2) is greater than a half L4 of a maximum dimension L3 of the handle opening Ha1, Ha2, Ha3. The maximum dimension L3 is measured along a lateral direction, notional line y-y of the blank 10 (see FIG. 1B).

Optionally, the blank 10 comprises a first recess or cutaway R1 struck from a first side edge (see FIG. 1). The first recess or cutaway R1 lies upon a notional line extending laterally of the blank 10 and bisecting the blank 10. In this way, the first recess or cutaway R1 lies between the second and third rows of article retention structures RT1.

Optionally, the blank 10 comprises a second recess or cutaway R2 struck from a second side edge. The second side edge opposes the first side edge. The first recess or cutaway R1 lies upon a notional line extending laterally of the blank 10 and bisecting the blank 10. In this way, the second recess or cutaway R2 lies between the second and third rows of article retention structures RT1. The first or second recess R1, R2 may be used along with the second handle opening Ha2 to lift and carry a carrier 90 which is formed from the blank 10.

Optionally, the blank 10 may comprise a third recess or cutaway (not shown) struck from a first end edge of the blank 10. The first end edge extends generally perpendicularly to the first and second side edges. The third recess or cutaway lies upon a notional line extending longitudinally of the blank 10 and bisecting the blank 10. In this way, the third recess or cutaway lies between the first and second columns of article retention structures RT1. Each column extends vertically as viewed in FIG. 1. The third recess or cutaway may be used along with the first handle opening Ha1 to lift and carry the carrier 90.

Optionally, the blank 10 may also comprise a fourth recess or cutaway (not shown) struck from a second end edge of the blank 10. The second end edge opposed the first end edge and extends perpendicularly to the first and second side edges. The fourth recess or cutaway lies upon a notional line extending longitudinally of the blank 10 and bisecting the blank 10. In this way, the fourth recess or cutaway lies between the first and second columns of article retention structures RT1. The fourth recess or cutaway may be used along with the third handle opening Ha3 to lift and carry the carrier 90.

The second handle opening Ha2 is collinear with the first and second recesses R1, R2.

The blank 10 forms a carrier 90, the blank 10 is lowered with respect to a group of articles B. Each opening of the retention structures RT1 receives one of the articles B forming the group. An end closure or upper end of the articles B passes through the openings. The tabs 14 fold out of the plane of the engaging panel 12. The tabs 14 fold upwardly, the tabs 14 engage an article B below a flange or projection extending radially outward from the neck of the article B. The tabs 14 support the article B and inhibit movement or withdrawal of the article B from the opening.

Referring now to FIGS. 3, 4, and 5, there is shown an additional embodiment of the present disclosure. In the second, third, and fourth illustrated embodiment like numerals have, where possible, been used to denote like parts, albeit with the addition of the prefix "100", "200", "300" to indicate that these features belong to the second, third, or fourth embodiment respectively. The additional embodiments share many common features with the first embodiment and therefor only the differences from the embodiment illustrated in FIGS. 1 and 2 will be described in detail.

FIG. 3 illustrates a second embodiment and shows a blank 110 for forming an article carrier (not shown).

The blank 110 comprises an engaging panel 112. The engaging panel 112 comprises a plurality of retention structures RT1, each retention structure RT1 provides an article receiving opening for receiving a respective article. The retention structures RT1 are substantially similar in construction to those described above in relation to the first illustrated embodiment and will not be described in further detail.

The blank 110 comprises a handle structure. The handle structure comprises a pair of handle or finger openings Ha1, Ha2 spaced apart from each other.

The handle or finger openings Ha1, Ha2 are disposed on a longitudinal axis x-x (see FIG. 3B) bisecting the engaging panel 112.

A first opening Ha1 is provided between a first group of four article retention structures RT1. The first group of four article retention structures RT1 is provided adjacent a first end of the engaging panel 112. The first opening Ha1 is disposed between a first row of article retention structures RT1 and a second row of article retention structures RT1. The first opening Ha1 is located at the centre C (see FIG. 1B) of the first group of four article retention structures RT1.

A second opening Ha2 is provided between a second group of four article retention structures RT1. The second group of four article retention structures RT1 is provided medially of the engaging panel 112. The second opening Ha2 is disposed between the second row of article retention structures RT1 and a third row of article retention structures RT1. The second opening Ha2 is located at the centre of the second group of four article retention structures RT1.

In the embodiment of FIG. 3 a handle opening is not provided between a third group of four article retention structures RT1. The third group of four article retention structures RT1 is provided adjacent a second end of the engaging panel 12 and is disposed between the third row of article retention structures RT1 and a fourth row of article retention structures RT1. In alternative embodiments a third opening Ha3 may be provided at the centre of the third group of four article retention structures RT1.

The first and second third openings Ha1, Ha2 lie between a first column of article retention structures RT1 and a second column of article retention structures RT1.

Each of the handle openings Ha1, Ha2 is defined by a plurality of tabs 140, 142. The first and second handle openings Ha1, Ha2 are substantially similar in construction to each other. The first handle opening Ha1 is a mirror image of the second handle opening Ha2. The handle openings Ha1, Ha2 will be described in further detail by reference to the first handle opening Ha1 shown in FIG. 3B.

Each handle opening Ha1, Ha2 comprises two tabs 140, 142. Each tab 140, 142 is hinged to the engaging panel 112 by a hinged connection in the form of a fold line 141, 143. An arcuate or curvilinear cut line 150, 152 may be provided between each fold line 141, 143. A first curvilinear cut line 152 defines a first corner or vertex of the handle openings Ha1, Ha2. A second curvilinear cut line 150 defines second, third and fourth corners or vertices of the handle openings Ha1, Ha2. Each of the handle openings Ha1, Ha2 is substantially kite shaped, in other embodiments other shapes may be employed such as, but not limited to square or parallelogram.

A first tab 140 is separated from a second tab 142 by a cut line or severable line 145.

The cut line 145 is colinear with a notional line x-x passing though the centre C of the group of four article retention structures RT1.

The cut line 145 may be linear in shape and extends between a first pair of opposed vertices of the handle opening Ha1, Ha2.

The first tab 140 is hinged to the engaging panel 112 by a first fold line 141. The second tab 142 is hinged to the engaging panel 112 by a second fold line 143.

The first fold line 141 is divergently arranged with respect to the second fold line 143.

The first tab 140 may comprises an optional fold line 147. The fold line 147 may be substantially parallel to the fold line 141 that hinges the first tab 140 to the engaging panel 112

Figure 3B:
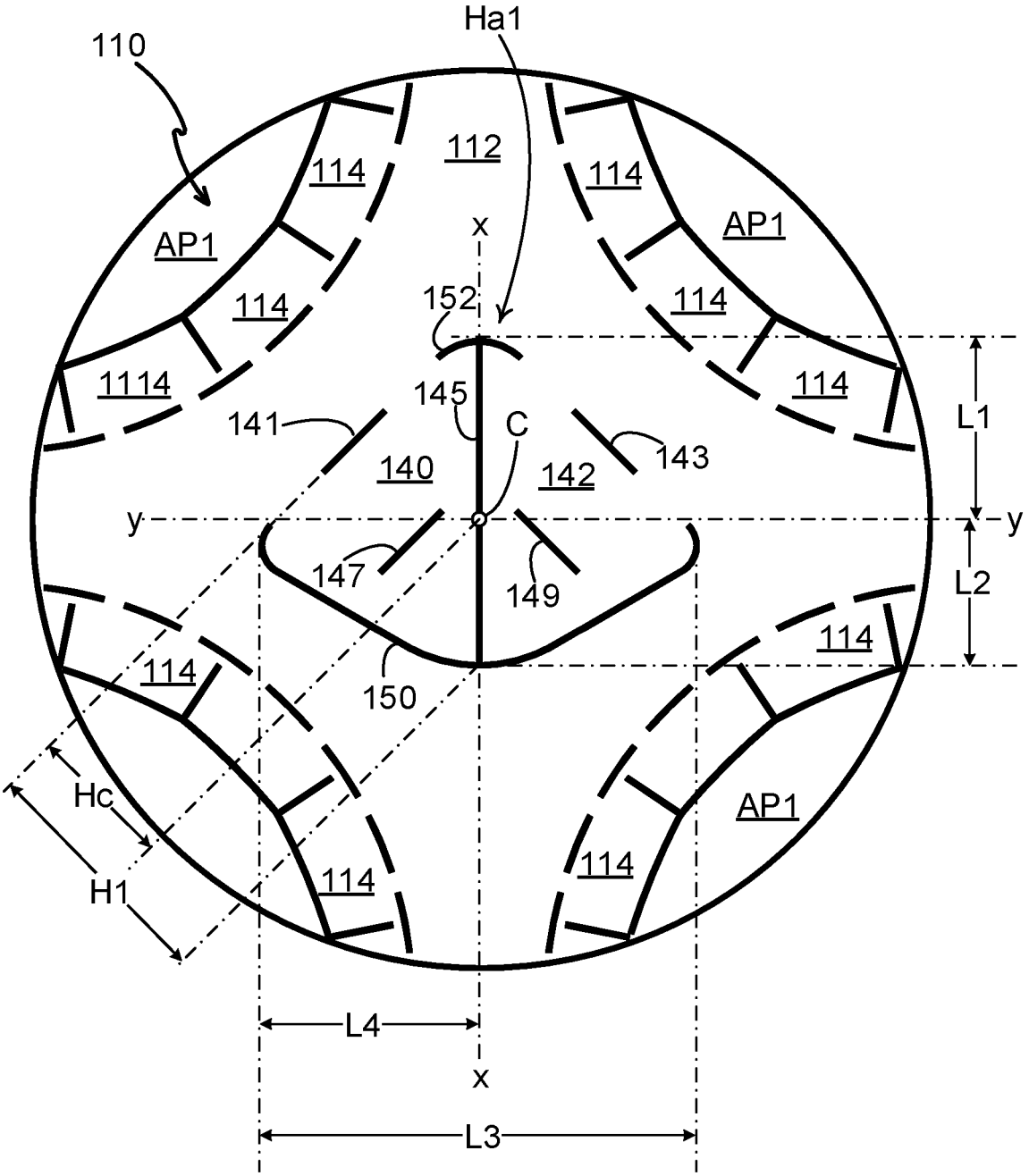
FIG. 3B is an enlarged plan view of a portion of the blank of FIG. 3.

The first and second tabs 140, 142 comprise a height dimension H1, see FIG. 3B. The height dimension H1 of the first and second tabs 140, 142 is greater than a distance Hc; where the distance Hc is defined between the centre C of the second group of article retention structures RT1 and the centre or midpoint of the fold line 141, 143 hinging the first and second tabs 140, 142 respectively to the engaging panel 112.

The first and second tabs 140, 142 are disposed next to each other and separated from each other by the cut line 145. The cut line 145 passes through the centre C of the first group of article retention structures RT1. The cut line 145 comprises a first segment defined between the centre C of the second group of article retention structures RT1 and a proximal end of the cut line 145. The proximal end of the cut line 145 is defined by a first nonlinear cut line 152 that is disposed between the first fold line 141 and the second fold line 143. The cut line 145 comprises a second segment defined between the centre C of the second group of article retention structures RT1 and a distal end of the cut line 145. The distal end of the cut line 145 is defined by a second nonlinear cut line 150 that is disposed between the first fold line 141 and the second fold line 143. The first segment has a first length dimension L1, the second segment has a second length dimension L2. The first length dimension L1 is greater than the second length dimension L2. In this way the first segment is a longer segment, the second segment is a shorter segment.

The cut line 145 comprises a third length dimension (L1+L2) which is equal to the sum of the first length dimension L1 and the second length dimension L2. The third length dimension (L1+L2) of the first cut line 25 is greater than a half L4 of a maximum dimension L3 of the handle opening Ha1, Ha2 measured along a lateral direction, as indicated by notional line y-y of the blank 10 in FIG. 3B.

FIG. 4 illustrates a third embodiment and shows a blank 210 for forming an article carrier (not shown).

The blank 210 comprises an engaging panel 212. The engaging panel 212 comprises a plurality of retention structures RT1, each retention structure RT1 provides an article receiving opening for receiving a respective article. The retention structures RT1 are substantially similar in construction to those described above in relation to the first illustrated embodiment and will not be described in further detail.

The blank 210 comprises a handle structure. The handle structure comprises a plurality of handle or finger openings Ha1, Ha2, Ha3 spaced apart from each other.

The handle or finger openings Ha1, Ha2, Ha3 are disposed on a longitudinal axis x-x bisecting the engaging panel 212.

The handle structure illustrated comprises three handle or finger openings Ha1, Ha2, Ha3.

A first opening Ha1 is provided between a first group of four article retention structures RT1. The first group of four article retention structures RT1 is provided adjacent a first end of the engaging panel 212. The first opening Ha1 is disposed between a first row of article retention structures RT1 and a second row of article retention structures RT1. The first opening Ha1 is located at the centre of the first group of four article retention structures RT1.

A second opening Ha2 is provided between a second group of four article retention structures RT1. The second group of four article retention structures RT1 is provided medially of the engaging panel 212. The second opening Ha2 is disposed between the second row of article retention structures RT1 and a third row of article retention structures RT1. The second opening Ha2 is located at the centre C (see FIG. 4B) of the second group of four article retention structures RT1.

A third opening Ha3 is provided between a third group of four article retention structures RT1. The third group of four article retention structures RT1 is provided adjacent a second end of the engaging panel 212. The third opening Ha3 is disposed between the third row of article retention structures RT1 and a fourth row of article retention structures RT1. The third opening Ha3 is located at the centre of the third group of four article retention structures RT1.

The first, second and third openings Ha1, Ha2, Ha3 lie between a first column of article retention structures RT1 and a second column of article retention structures RT1.

Each of the handle openings Ha1, Ha2, Ha3 is defined by a plurality of tabs 216, 218, 220, 222, 280, 282, 284, 286. The first and third handle openings Ha1, Ha3 are substantially similar in construction to each other albeit mirror images of each other. The first and third handle openings Ha1, Ha3 are substantially square in shape albeit with rounded or filleted corners. Each of the first and third handle openings Ha1, Ha3 is substantially similar in construction to handle openings Ha1, Ha2, Ha3 of the embodiment illustrated in FIGS. 1 and 1B and described above and will not be discussed in further detail.

The second handle opening Ha2 will be described in further detail by reference to FIG. 4B.

The second handle opening Ha2 comprises four tabs 280, 282, 284, 286. Each tab 280, 282, 284, 286 is hinged to the engaging panel 212 by a hinged connection in the form of a fold line 283*a*, 283*b*, 285*a*, 285*b*. A first arcuate or curvilinear cut line 281 may be provided between a first pair 283*a*, 283*b* of the fold lines 283*a*, 283*b*, 285*a*, 285*b* to define a first corner or vertex of the second handle opening Ha2. A second arcuate or curvilinear cut line 289 may be provided between a second pair 285*a*, 285*b* of the fold lines 283*a*, 283*b*, 285*a*, 285*b* to define a second, opposing, corner or vertex of the second handle opening Ha2. The second handle opening Ha2 comprises an aperture A1 struck from the engaging panel 212. The aperture A1 extends between and defines a second pair of opposed corners or vertices of the second handle opening Ha2. The aperture A1 interrupts or spaces apart a first fold line 283*a* from a third fold line 285*a* and interrupts or spaces apart a second fold line 283*b* from a fourth fold line 285*b*.

The aperture A1 separates or spaces apart a first pair 280, 282 of the tabs 280, 282, 284, 286 from a second pair 284, 286 of the tabs 280, 282, 284, 286.

A first cutline 287*a* separates a first one 280 of the first pair 280, 282 of tabs 280, 282, 284, 286 from a second one 282 of the first pair 280, 282 of tabs 280, 282, 284, 286.

A second cutline 287*b* separates a first one 284 of the second pair 284, 286 of tabs 280, 282, 284, 286 from a second one 286 of the second pair 284, 286 of tabs 280, 282, 284, 286.

The first cutline 287*a* and the second cutline 287*b* each lies upon, or is collinear with, a notional line x-x passing through the centre C of the second group of four article retention structures RT1.

Figure 4B:
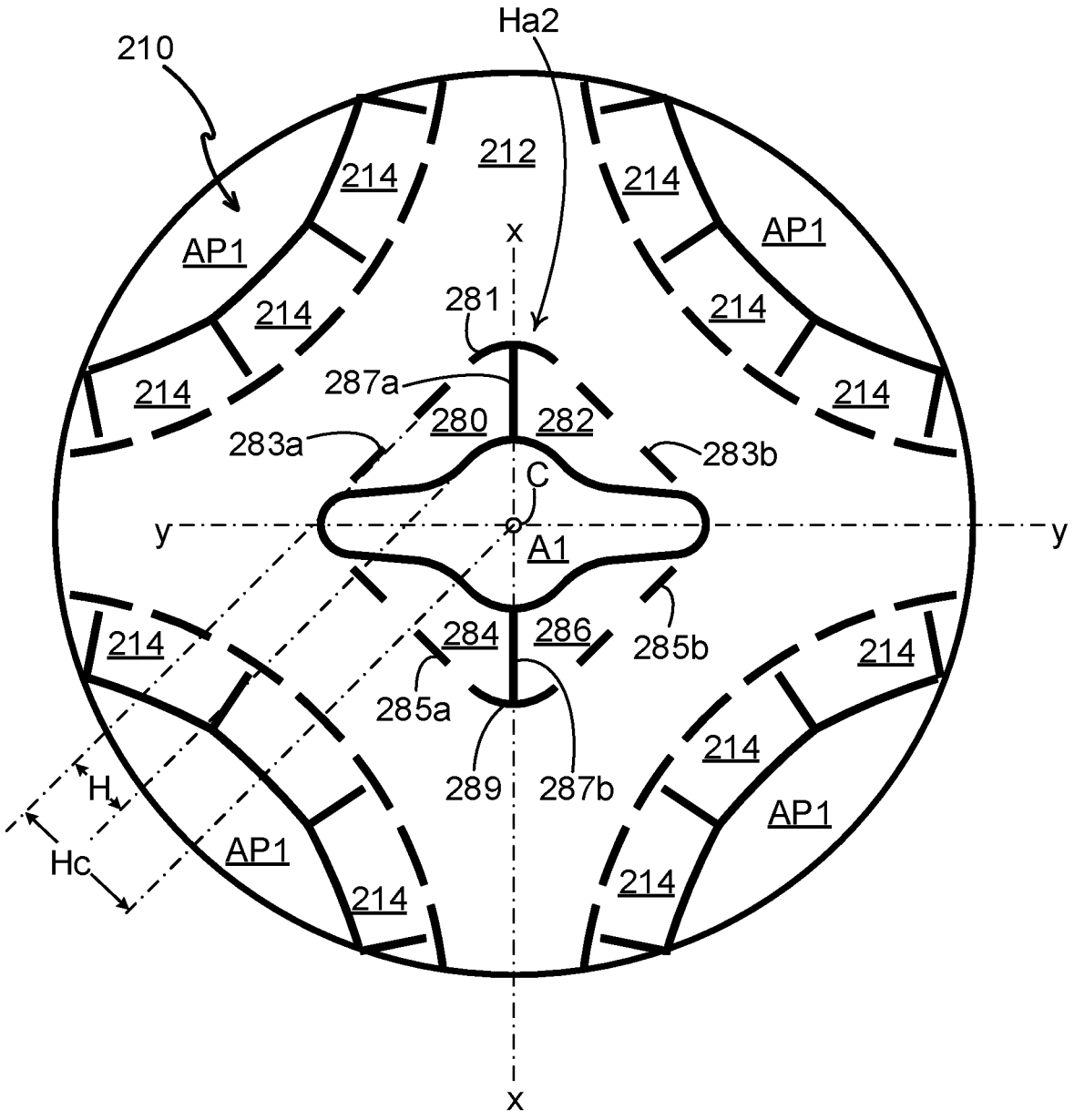
FIG. 4B is an enlarged plan view of a portion of the blank of FIG. 4.

The tabs 280, 282, 284, 286 comprise a height dimension H, see FIG. 4B. The height dimension H of the tabs 280, 282, 284, 286 is less than a distance Hc; where the distance Hc is defined between the centre C of the second group of article retention structures RT1 and the centre or midpoint of a fold line 283*a*, 283*b*, 285*a*, 285*b* hinging the respective tab 280, 282, 284, 286 to the engaging panel 212.

FIG. 5 illustrates a fourth embodiment and shows a blank 310 for forming an article carrier (not shown).

The blank 310 comprises an engaging panel 312. The engaging panel 312 comprises a plurality of retention structures RT1, each retention structure RT1 provides an article receiving opening for receiving a respective article. The retention structures RT1 are substantially similar in construction to those described above in relation to the first illustrated embodiment and will not be described in further detail.

The blank 310 comprises a handle structure. The handle structure comprises a plurality of handle or finger openings Ha1, Ha2, Ha3 spaced apart from each other.

The handle or finger openings Ha1, Ha2, Ha3 are disposed on a longitudinal axis x-x bisecting the engaging panel 312.

The handle structure illustrated comprises three handle or finger openings Ha1, Ha2, Ha3.

A first opening Ha1 is provided between a first group of four article retention structures RT1. The first group of four article retention structures RT1 is provided adjacent a first end of the engaging panel 312. The first opening Ha1 is disposed between a first row of article retention structures RT1 and a second row of article retention structures RT1. The first opening Ha1 is located at the centre of the first group of four article retention structures RT1.

A second opening Ha2 is provided between a second group of four article retention structures RT1. The second group of four article retention structures RT1 is provided medially of the engaging panel 312. The second opening Ha2 is disposed between the second row of article retention structures RT1 and a third row of article retention structures RT1. The second opening Ha2 is located at the centre C (see FIG. 5B) of the second group of four article retention structures RT1.

A third opening Ha3 is provided between a third group of four article retention structures RT1. The third group of four article retention structures RT1 is provided adjacent a second end of the engaging panel 312. The third opening Ha3 is disposed between the third row of article retention structures RT1 and a fourth row of article retention structures RT1. The third opening Ha3 is located at the centre of the third group of four article retention structures RT1.

The first, second and third openings Ha1, Ha2, Ha3 lie between a first column of article retention structures RT1 and a second column of article retention structures RT1.

Each of the handle openings Ha1, Ha2, Ha3 is defined by a plurality of tabs 340, 342, 370, 372, 374, 376. The first and third handle openings Ha1, Ha3 are substantially similar in construction to each other albeit mirror images of each other. The first and third handle openings Ha1, Ha3 are substantially diamond shaped albeit with rounded or filleted corners. Each of the first and third handle openings Ha1, Ha3 is substantially similar in construction to handle openings Ha1, Ha2 of the embodiment illustrated in FIGS. 3 and 3B and described above and will not be discussed in further detail.

The second handle opening Ha2 will be described in further detail by reference to FIG. 5B.

The second handle opening Ha2 comprises four tabs 370, 372, 374, 376. Each tab 370, 372, 374, 376 is hinged to the engaging panel 312 by a hinged connection in the form of a fold line 373*a*, 373*b*, 375*a*, 375*b*. An arcuate or curvilinear cut line 371*a*, 371*b*, 379*a*, 379*b* may be provided between adjacent pairs of the fold lines 373*a*, 373*b*, 375*a*, 375*b* to define a corner or vertex of the second handle opening Ha2.

A first portion of a first cutline 377*a* separates a first tab 370 from a second tab 372. A second portion of the first cutline 377*a* separates a third tab 374 from a fourth tab 376.

The first and second portions of the first cutline 377*a* extend from a proximal end at one of a first or third arcuate cut line 371*a*, 371*b* to a distal end at the centre C of the second group of four article retention structures RT1.

A first portion of a second cutline 377*b* separates the first tab 370 from the third tab 374. A second portion of the second cutline 377*b* separates the second tab 372 from the fourth tab 376.

The first and second portions of the second cutline 377*b* extend from a proximal end at one of a second or fourth arcuate cut line 379*a*, 379*b* to a distal end at the centre C of the second group of four article retention structures RT1.

The first cutline 377*a* lies upon or is collinear with a first notional line x-x passing through the centre C of the second group of four article retention structures RT1.

The second cutline 377*b* lies upon or is collinear with a second notional line y-y passing through the centre C of the second group of four article retention structures RT1. The second notional line y-y is perpendicular to the first notional line x-x.

Figure 5B:
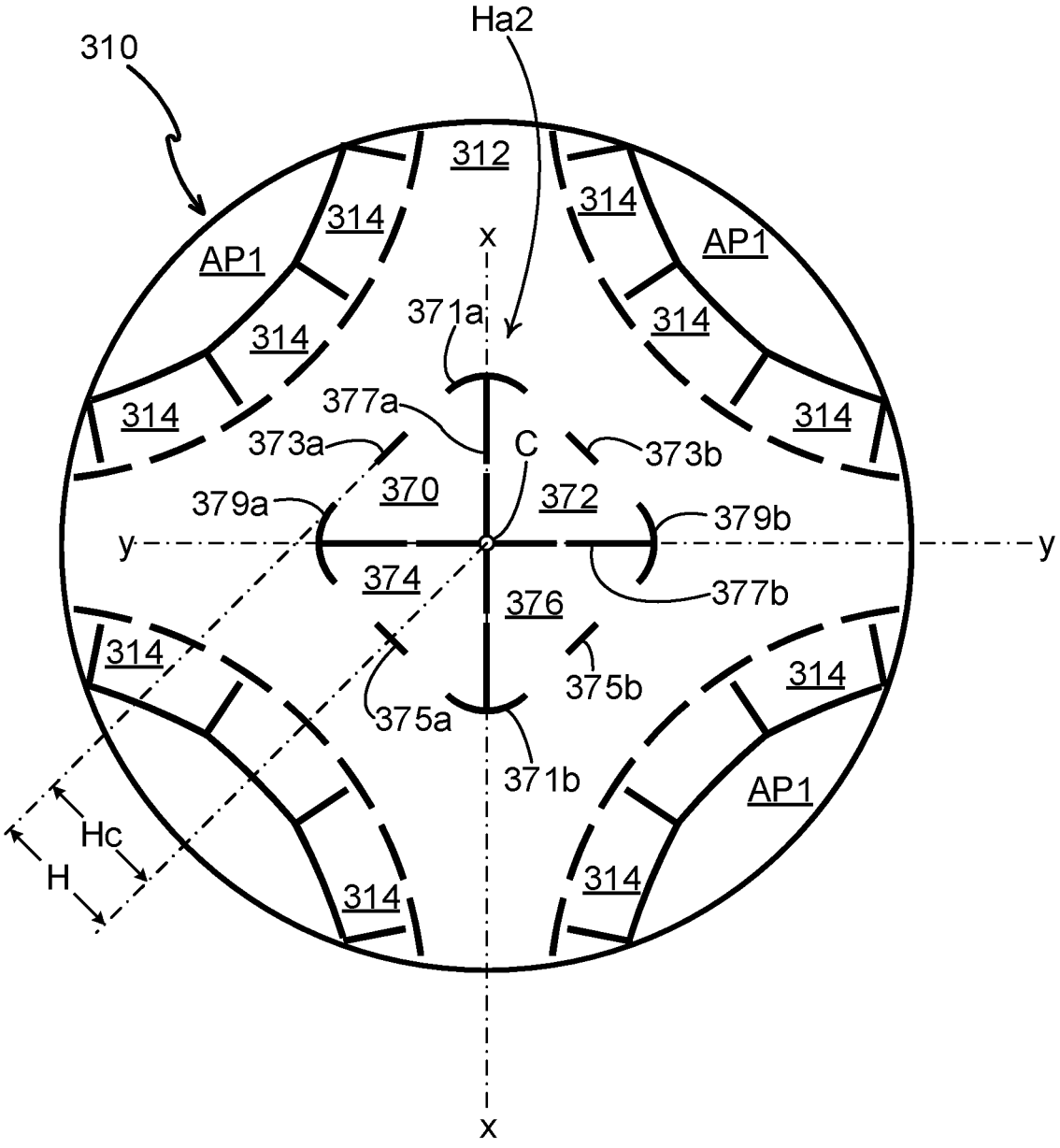
FIG. 5B is an enlarged plan view of a portion of the blank of FIG. 5.

Each of the tabs 370, 372, 374, 376 comprises a height dimension H, see FIG. 5B. The height dimension H of the tabs 370, 372, 374, 376 is equal to a distance Hc; where the distance Hc is defined between the centre C of the second group of article retention structures RT1 and the centre or midpoint of a fold line 373*a*, 373*b*, 375*a*, 375*b* hinging the respective tab 370, 372, 374, 376 to the engaging panel 312.

The present disclosure provides a carrier 90, and a blank 10; 110; 210; 310 for forming the carrier 90, having a main panel 12; 112; 212; 312 with openings for receiving at least one article B and a handle structure.

The present disclosure provides a blank for forming an article carrier, the blank 10; 110; 210; 310 or article carrier 90 comprises at least one panel 12; 112; 212; 312 having at least four article receiving openings RT1. The at least one panel 12; 112; 212; 312 comprises a handle feature. The at least article receiving openings RT1 are arranged in two rows. The handle feature comprises at least one handle opening Ha1, Ha2, Ha3 located at a centre C of the at least four article receiving openings RT1. The at least one handle opening Ha1, Ha2, Ha3 is defined at least in part by a pair of first tabs 16, 18; 140, 142; 216, 218; 340, 342, 370, 372, 374, 376 hingedly connected to the at least one panel 12; 112; 212; 312 by a pair of first divergent fold lines 17, 19; 141, 143; 341, 343, 373*a*, 373*b*, 375*a*, 375*b* respectively. Each of the first tabs 16, 18; 140, 142; 216, 218; 340, 342, 370, 372, 374, 376 comprises a height dimension H1 extending between the respective first fold line 17, 19; 141, 143; 341, 343, 373*a*, 373*b*, 375*a*, 375*b* and a free end of that first tab 16, 18; 140, 142; 216, 218; 340, 342, 370, 372, 374, 376. The height dimension H1 may be equal to or greater than a distance Hc between the centre C and each of the first fold lines 17, 19; 141, 143; 341, 343, 373*a*, 373*b*, 375*a*, 375*b*.

The present disclosure provides a blank for forming an article carrier, the blank 10; 110; 210; 310 or article carrier 90 comprises at least one panel 12; 112; 212; 312 having at least four article receiving openings RT1. The at least one panel 12; 112; 212; 312 comprises a handle feature. The at least article receiving openings RT1 are arranged in two rows. The handle feature comprises at least one handle opening Ha1, Ha2, Ha3 located at a centre C of the at least four article receiving openings RT1. The at least one handle opening Ha1, Ha2, Ha3 is defined at least in part by a pair of first tabs 16, 18; 140, 142; 216, 218; 340, 342, 370, 372, 374, 376 hingedly connected to the at least one panel 12; 112; 212; 312 by a pair of first divergent fold lines 17, 19; 141, 143; 341, 343, 373*a*, 373*b*, 375*a*, 375*b* respectively. The first tabs 16, 18; 140, 142; 216, 218; 340, 342, 370, 372, 374, 376 are disposed next to each other and separated from each other by a cut 25; 145 passing through the centre C such that the cut 25; 145 is divided into a first segment L1 on a first side of the centre C and second segment L2 on a second side of the centre C, the second segment L2 being shorter than the first segment L1.

The cut 25; 145 comprises a length (L1+L2) which may be greater than a half L3 of a maximum dimension L4 of the at least one handle opening Ha1, Ha2, Ha3 measured along the lateral direction y-y of the blank 10; 110, 210; 310.

The present disclosure provides a blank for forming an article carrier, the blank 10; 110; 210; 310 or article carrier 90 comprises at least one panel 12; 112; 212; 312 having at least four article receiving openings RT1. The at least one panel 12; 112; 212; 312 comprises a handle feature. The at least article receiving openings RT1 are arranged in two rows. The handle feature comprises at least one handle opening Ha1, Ha2, Ha3 located at a centre C of the at least four article receiving openings RT1. The at least one handle opening Ha1, Ha2, Ha3 being defined at least in part by a pair of second tabs 20, 22; 220, 222; 280, 282, 284, 286; 370, 372, 374, 376 hingedly connected to the at least one panel 12; 112; 212; 312 by a pair of second divergent fold lines 21, 23; 283*a*, 283*b*, 285*a*, 285*b*; 373*a*, 373*b*, 375*a*, 375*b* respectively. Each of the second tabs 20, 22; 220, 222; 280, 282, 284, 286; 370, 372, 374, 376 having a height dimension H, H2 extending between the respective second fold line 21, 23; 283*a*, 283*b*, 285*a*, 285*b*; 373*a*, 373*b*, 375*a*, 375*b* and a free end of that second tab 20, 22; 220, 222; 280, 282, 284, 286; 370, 372, 374, 376. The height dimension H, H2 being equal to or less than a distance between the centre C and each of the second fold lines 21, 23; 283*a*, 283*b*, 285*a*, 285*b*; 373*a*, 373*b*, 375*a*, 375*b*.

The present disclosure provides a blank for forming an article carrier, the blank 10; 110; 210; 310 or article carrier 90 comprises at least one panel 12; 112; 212; 312 having at least four article receiving openings RT1. The at least one panel 12; 112; 212; 312 comprises a handle feature. The at least article receiving openings RT1 are arranged in two rows. The handle feature comprises at least one handle opening Ha1, Ha2, Ha3 located at a centre C of the at least four article receiving openings RT1. The at least one aperture being defined at least in part by a pair of tabs 16, 18, 20, 22; 140, 142; 216, 218, 220, 222, 280, 282, 284, 286; 340, 342, 370, 372, 374, 376 hingedly connected to the at least one panel 12; 112; 212; 312 by a pair of divergent fold lines 17, 19, 21, 23; 141, 143; 283*a*, 283*b*, 285*a*, 285*b*; 341, 343, 373*a*, 373*b*, 375*a*, 375*b* respectively. The tabs 16, 18, 20, 22; 140, 142; 216, 218, 220, 222, 280, 282, 284, 286; 340, 342, 370, 372, 374, 376 are disposed next to each other and separated from each other by a cut 25; 145; 287*a*, 287*b*; 345, 377*a*, 377*b* which is collinear with a notional line x-x, y-y passing though the centre C.

The cut 377*a*, 377*b* may terminate at a distal end, the distal end being located on a free end edge of the tab 370, 372, 374, 376. The distal end may be located at or on the centre C.

The cut 25; 145; 287*a*, 287*b*; 345 may terminate at a distal end, the distal end being located on a free end edge of the tab 370, 372, 374, 376, the distal end may be spaced apart from the centre C.

The cut 25; 145; 287*a*, 287*b*; 345, 377*a*, 377*b* comprises a length which may be equal to, or less than, a half L3 of a maximum dimension L4 of the at least one handle opening Ha1, Ha2, Ha3 measured along the notional line y-y.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A blank for forming an article carrier, the blank comprising at least one panel having at least four article receiving openings and a handle feature, the at least four article receiving openings being arranged in two rows, the handle feature comprising at least one handle opening located at a centre of the at least four article receiving openings, the at least one handle opening being defined at least in part by a pair of first tabs each hingedly connected to the at least one panel by a respective first fold line divergently arranged with respect to one another, each of the first tabs having a height dimension extending between its respective first fold line and a free end of the first tab, the height dimension being equal to or greater than a distance between the centre and the respective first fold line.

2. A blank according to claim 1, wherein each of the first pair of tabs are disposed next to each other and separated from each other by a cut passing through the centre such that the cut is divided by the centre into a first segment and a second segment, the second segment being shorter than the first segment.

3. A blank according to claim 2 wherein the length of the cut is greater than a half of a maximum dimension of the at least one handle opening measured along a lateral direction of the blank.

4. A blank according to claim 1, wherein the at least one handle opening is defined at least in part by a pair of second tabs each hingedly connected to the at least one panel by a respective second fold line, each of the second tabs having a height dimension extending between its respective second fold line and a free end of the second tab, the height dimension being equal to or less than a distance between the centre and the respective second fold line.

5. A blank according to claim 1, wherein the first tabs are disposed next to each other and separated from each other by a cut which is collinear with a notional line passing through the centre.

6. A blank according to claim 5 wherein the cut terminates on the centre.

7. A blank according to claim 5 wherein the cut comprises a proximal terminal end located at an edge of the at least one handle opening and distal terminal end which is spaced apart from the centre.

8. A blank according to claim 5 wherein the cut comprises a length that is equal to or less than half of a maximum dimension of the at least one handle opening measured along the notional line.

9. A blank according to claim 1, wherein the at least one handle opening is defined in part by a pair of second tabs hingedly connected to the at least one panel.

10. A blank according to claim 1, wherein the height dimension is greater than the distance between the centre and the respective first fold line.

11. A blank for forming an article carrier, the blank comprising at least one panel having at least four article receiving openings and a handle feature, the handle feature comprising at least one handle opening located at a centre of the at least four article receiving openings, wherein the at least one handle opening is defined in part by a pair of tabs each connected to the at least one panel by a respective fold line divergently arranged with respect to one another, each of the tabs has a height dimension that extends between its respective fold line and a free end of the tab, the height dimension is less than a distance between the centre and the respective fold line.

12. A blank according to claim 11, wherein the at least four article receiving openings are arranged in at least two rows.

13. A blank according to claim 11, wherein the tabs are disposed next to each other and separated from each other by a cut which is collinear with a notional line passing through the centre.

14. A blank according to claim 11, wherein the at least one handle opening is defined at least in part by a further pair of tabs each hingedly connected to the at least one panel by a respective second fold line, each of the further pair of tabs having a height dimension extending between its respective second fold line and a free end of the tab, the height dimension being equal to or less than a distance between the centre and the respective second fold line.

15. An article carrier for packaging a plurality of articles, the article carrier comprising at least one panel having at least four article receiving openings and a handle feature, the at least four article receiving openings being arranged in two rows, the handle feature comprising at least one handle opening located at a centre of the at least four article receiving openings, the at least one handle opening being defined at least in part by a pair of first tabs each hingedly connected to the at least one panel by a respective first fold line divergently arranged with respect to one another, each of the first tabs having a height dimension extending between its respective first fold line and a free end of the first tab, the height dimension being equal to or greater than a distance between the centre and the respective first fold line.

16. An article carrier according to claim 15, wherein each of the first pair of tabs are disposed next to each other and separated from each other by a cut passing through the centre such that the cut is divided by the centre into a first segment and a second segment, the second segment being shorter than the first segment.

17. An article carrier according to claim 15, wherein the at least one handle opening is defined at least in part by a pair of second tabs each hingedly connected to the at least one panel by a respective second divergent fold line, each of the second tabs having a height dimension extending between its respective second divergent fold line and a free end of the second tab, the height dimension being equal to or less than a distance between the centre and the respective second divergent fold line.

18. An article carrier according to claim 15, wherein each of the first pair of tabs are disposed next to each other and separated from each other by a cut which is collinear with a notional line passing through the centre.

19. An article carrier according to claim 15, wherein the at least one handle opening is defined in part by a pair of second tabs hingedly connected to the at least one panel.

20. An article carrier according to claim 15, wherein the height dimension is greater than the distance between the centre and the respective first fold line.

* * * * *